United States Patent [19]

Hickey et al.

[11] 3,937,453

[45] Feb. 10, 1976

[54] SINGLE DOCUMENT TRANSPORT

[75] Inventors: Richard C. Hickey, Plano; Jerry W. Swafford, Dallas; Robert F. Swartzendruber, Plano; Thomas P. Barnes, Dallas, all of Tex.

[73] Assignee: Docutel Corporation, Irving, Tex.

[22] Filed: Aug. 2, 1974

[21] Appl. No.: 494,331

[52] U.S. Cl. ..... 271/4; 271/64; 271/110; 271/122; 271/259; 271/263

[51] Int. Cl.[2].. B65H 3/52; B65H 7/14; B65H 29/62

[58] Field of Search ..... 271/263, 262, 259, 122, 271/125, 64, 111, 110, 265, 172, 4, 5, 6, 10, 11, 12, 34, 35

[56] References Cited

UNITED STATES PATENTS

| | | | |
|---|---|---|---|
| 3,339,918 | 9/1967 | Goto | 271/64 |
| 3,724,687 | 4/1973 | Marschke | 271/11 X |
| 3,754,754 | 8/1973 | Peterson | 271/122 |
| 3,795,395 | 3/1974 | Ransom et al. | 271/4 |

*Primary Examiner*—John J. Love
*Assistant Examiner*—Bruce H. Stoner, Jr.
*Attorney, Agent, or Firm*—Richards, Harris & Medlock

[57] ABSTRACT

Banking machines for dispensing paper currency require a document transport for accurately and reliably delivering a single bill or piece of currency from a storage bin to a customer. The document transport includes a feeder unit for delivering single pieces of currency from a stack to a pair of separator rollers and past a double document detector. Upon detection of more than one document passing through the separator rollers, a clutch is energized to cause one of the rollers to rotate in a direction opposite the other to separate the several bills and allow only the top one to be forwarded into a flat belt transport. As a piece of paper currency passes through the flat belt transport, spaced detectors produce a signal that indicates an overlapping or trailing document condition. This overlapping or trailing condition is measured by the spacing of detectors in the flat belt transport. Further, positioned along the flat belt transport is a second double document detector that again responds to more than one document passing therebetween. If either an overlapping document condition, a trailing document condition, or a double document condition is sensed in the flat belt transport, a divert gate operates to divert all documents from the flat belt transport into a retaining bin. Should the divert gate fail to operate in time to divert a document, the transport belt stops to restrict further document delivery.

19 Claims, 8 Drawing Figures

SINGLE DOCUMENT TRANSPORT

This invention relates to a document transportation system, and more particularly to a document transport system for moving document singly.

Document or sheet feeding systems have employed many different mechanisms and devices designed to restrict simultaneous feeding or conveying of two or more documents. Except for the basic fixed throat size separators which may be found in numerous document transport systems, most separating mechanisms can be classified as counter rotation devices. Such devices use a constantly rotating friction roller which serves to effect the separation of multiple documents and is situated in the region of a pile of articles or documents. A restraining member follows the friction roller at a distance which is shorter than the length of a document, and a guide member is arranged opposite to the restraining member at a distance of less than the thickness of two documents, in which, joined with the restraining member prevents the simultaneous passage of more than one document. The counter rotation devices are positioned downstream from the restraining member and engage the face of a document in a direction opposite to the document travel. If there are overlapping documents passing along the guide member containing these counter rotation devices, they act on the overlapping document restricting movement of one document and allowing the other to continue through the guide member. Finally, downstream of this "reversely rotating" double roller, there is also provided a plurality of conveyor rollers which form the conveyor path.

Many presently available counter rotation roller transport mechanisms continuously drive the rollers in the opposite direction thereby requiring a high torque drive to assure document transportation of a single document. This high torque requirement also results in a rapid wearing of the counter rotating rollers which require accurate preloading to assure reliable document separation. A further shortcoming of prior transport systems is that many, while separating overlapping documents, will not prevent the transportation of both documents through the system. In a currency bill dispenser, it is not only essential to prevent double document transport but also to eliminate the transporting of a second document after separation of overlapping documents.

A feature of the present invention is to provide a document transport system wherein there is an initial separation of overlapping documents to return one document to the supply stack and the second document into a transport system. This initial separation of documents is completed at a separator roller pair wherein one of the rollers is moved counter to the other only upon detection of an overlapping or double document condition. During a single document delivery one of the separator rollers is driven in a direction of a transport belt mechanism and the other roller moves freely.

Another feature of the present invention is to monitor a document moving through a belt transport for evaluation of an overlapping document condition. When two spaced sensors both respond to a document presence a condition exists where overlapping documents are moving through the transport system. Signals from the spaced sensors actuate a divert mechanism into the path of the advancing documents for deflection into a capture bin.

Still another feature of the present invention is to provide increased reliability of double document detection by multiple check stations. Downstream of a pair of separator rollers and in a belt transport system, a second double document detector responds to more than one document moving through the belt transport. When multiple document movement is detected, the divert mechanism is also actuated into the path of the advancing document to divert it into a capture bin.

The document feeding mechanism forming the subject matter of the present invention is adapted for any use wherein it is desired to move a document at a time from a supply stack. The mechanism is particularly adapted to operate in a banking machine dispensing paper currency wherein accurate and reliable single document delivery is mandatory. However, it is to be understood that the feeding mechanism forming the present invention is adaptable to operate in other environments, such as, but not limited to, delivery of postal articles or documents of financial transactions such as cancelled checks.

In accordance with the present invention, a document transport system for individually transporting documents from a stack to a remote distribution station includes a pair of separator rollers rotating to move a document in the direction of the distribution station. The document is removed from the stack and delivered to the pair of separator rollers. At the separator rollers, a detector responds to more than one document that enters between the rollers. This detector generates a signal to actuate a drive to rotate one of the rollers in a direction opposite from the other for separating more than one document passing through the roller pair.

Further, in accordance with the present invention, a document is delivered into a flat belt transport that includes a detector arrangement responsive to more than one document moving through the transport. This detector arrangement provides signals to a divert gate to divert the transported documents in the flat belt transport to a capture bin from the distribution station.

For a more complete understanding of the invention and its advantages, reference may now be had to the following description taken in conjunction with the accompanying drawings.

Referring to the drawings.

Figure 1:
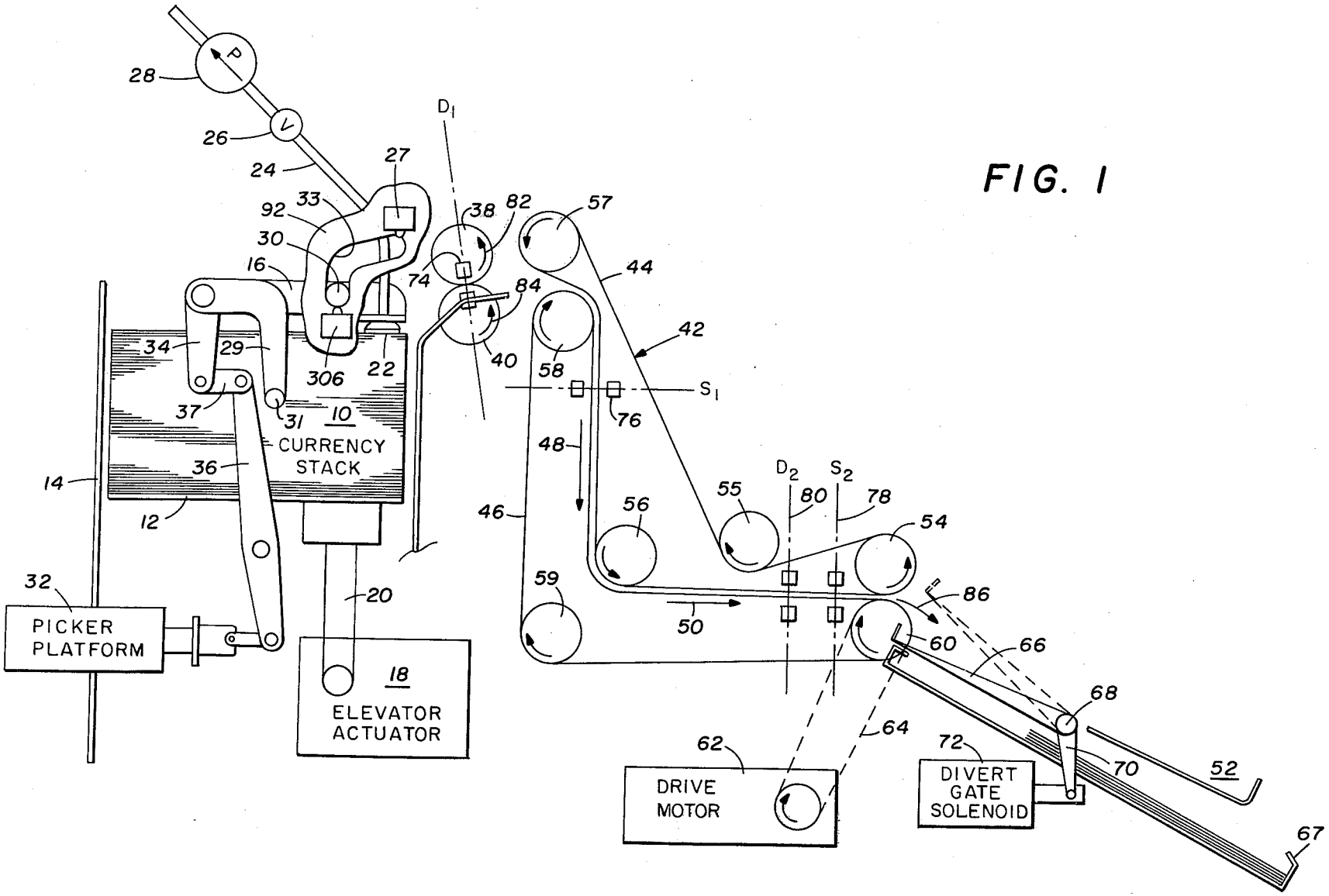
FIG. 1 is a schematic of the document transport of the present invention including an initial double document separation at a separator roller pair and subsequent double document detection and document diverting into a capture bin.
Figure 2:
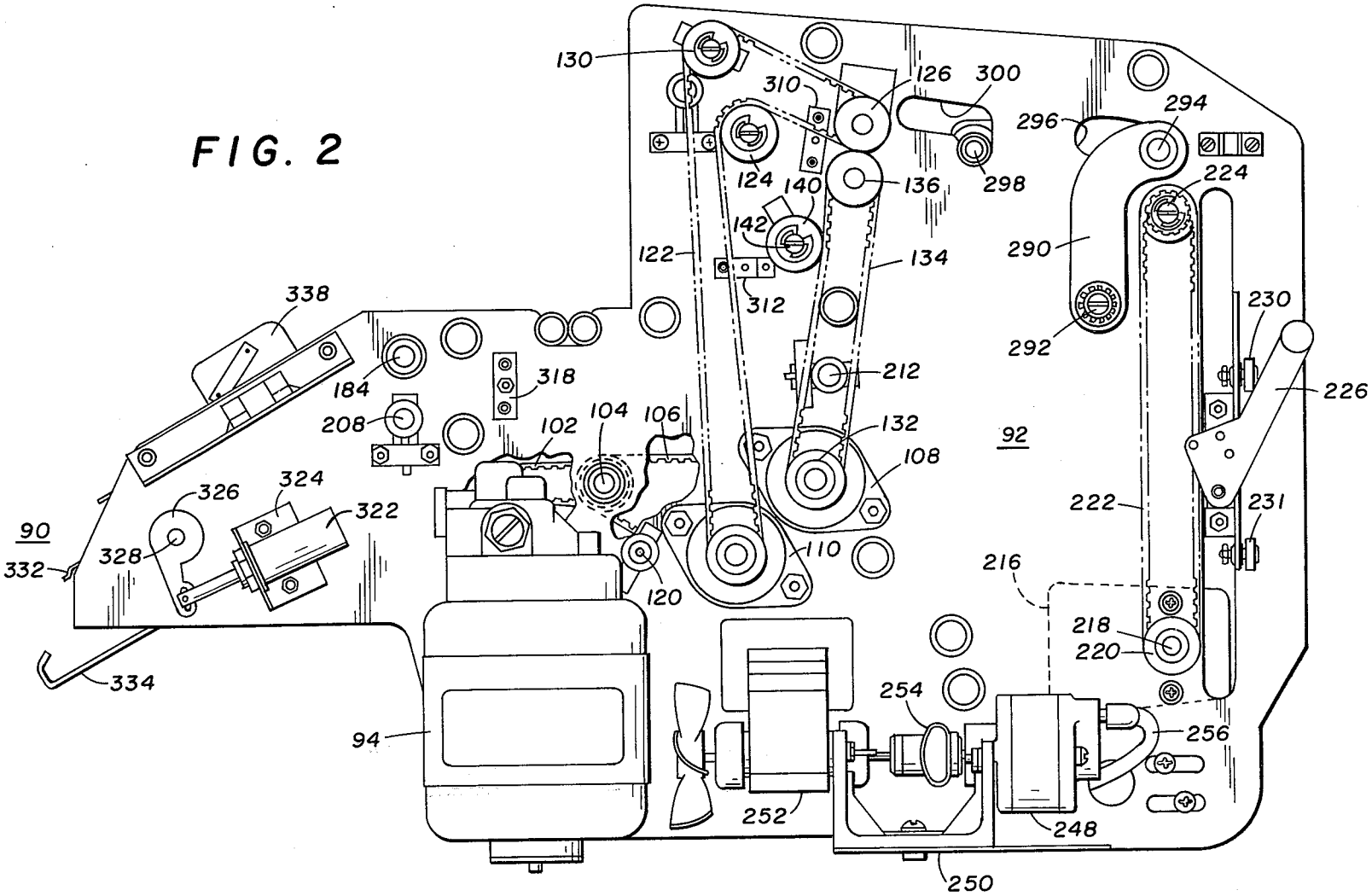
FIG. 2 is a right side view of a document transport constructed in accordance with the present invention.

Referring to FIG. 1, documents to be dispensed through the transport system, such as paper currency, are maintained in a stack 10 on an elevator platform 12 within a housing 14, shown schematically. By means of control circuitry (not shown) the platform 12 is incrementally raised to maintain the top document of the stack 10 immediately below a picker platform 16. This incremental raising of the platform 12 is accomplished by means of an elevator actuator 18 coupled through a flexible belt 20 to the platform 12.

To deliver a document from the top of the stack 10 to the transport system, the picker platform 16 is provided with a suction cup pickup 22 coupled by means of a flexible line 24 through a solenoid operated valve 26 to a vacuum pump 28. The picker platform 16 is rotated from the position shown by a platform solenoid 32 and with a vacuum applied to the suction cup pickup 22 only the top document is lifted from the stack 10. The picker platform 16 is connected to the platform solenoid 32 through linkages 34 and 36 and a converting link 37. The picker platform 16 moves up and forward by means of a lift arm 29 pivoted at a point 31. The path of travel of the platform 16 is determined by a roller 30 moving in an L-shaped slot 33. At the upper extent of its travel the platform 16 actuates a switch 27 to control the valve 26.

As the top document is lifted from the stack 10 by the picker platform 16 it is delivered to a separator roller pair including an upper roller 38 and a lower roller 40. The upper separator roller 38 is driven in a direction indicated by the arrow 82 and is in frictional engagement with a normally freely rotating lower separator roller 40. A document delivered from the stack 10 is fed to the nip of the roller pair 38 and 40 that feeds it into a flat belt transport 42.

The flat belt transport 42 consists of an upper continuous flat belt 44 in surface contact with a lower continuous flat belt 46. A document fed into the flat belt transport 42 from the separator rollers 38 and 40 is frictionally engaged between the two flat belts 44 and 46 to be transported along a path as indicated by the arrows 48 and 50 to a remote distribution station 52. The upper flat belt 44 and the lower flat belt 46 are guided to establish the transport path of the arrows 48 and 50 by means of guide rollers 54–60.

A drive motor 62 is coupled to the guide rollers by means of a timing belt 64 to provide rotation of each of the rollers in a direction as indicated by the respective arrows. Intermediate between the discharge end of the flat belt transport 42 and the remote distribution station 52 is a divert gate 66 pivotally mounted on an axis 68 and including an actuator arm 70. The actuator arm is coupled to a divert gate solenoid 72.

Located at the separator rollers 38 and 40 is a first double detector 74, typically, a light emitting source, such as a light emitting diode, on one side of the document path and a light responsive means, such as a phototransistor, on the opposite side of the document path that responds to a condition when more than one document is delivered by the picker platform 16 to the separator rollers 38 and 40. When more than one document is detected as passing between the rollers 38 and 40, the roller 40 is energized to rotate in the direction of the arrow 84 to return one document to the stack 10 while the roller 38 continues to feed one document to the flat belt transport 42.

Immediately downstream of the detector 74 is a detector station 76 that responds to the movement of a document therethrough. The detector station 76 has a fixed path distance from a second detector station 78 immediately ahead of the guide rollers 54 and 60. This detector station 78 also responds to the movement of a document therethrough. By properly spacing the stations 76 and 78, overlapping or trailing documents passing through the flat belt transport 42 are detected. When a single document is passing through the transport 42, as the leading edge of the document is sensed at the station 78 the trailing edge will be downstream of the station 76. If both the stations 76 and 78 respond to the presence of a document, then a signal is generated indicating an overlapping document condition. This signal actuates the divert gate solenoid 72 to rotate the divert gate 66 into the path of the documents exiting from the flat belts 44 and 46.

Also located within the flat belt transport 42 is a double detector station 80 that responds to the simultaneous passage of two documents therethrough. Upon the detection of more than one document passing the station 80, a signal is also generated to the divert gate solenoid 72 to rotate the divert gate 66 into the path of the documents. Documents diverted by the gate 66 are delivered to a capture bin 67. In operation of the document transport of FIG. 1, the drive motor 62 and the vacuum pump 28 are energized. Energizing the drive motor 62 puts the flat belt transport 42 into motion and energizing the vacuum pump 28 provides a negative pressure at the solenoid valve 26. Next, the solenoid valve 26 is energized along with a clutch to couple the separator roller 38 to the drive motor 62 to cause rotation thereof in the direction of the arrow 82. Also energized at this time is the platform solenoid 32 to rotate the picker platform 16 up and forward in a path as determined by the slot 33.

A document is picked up by the picker platform 16 and inserted into the nip of the separator rollers 38 and 40. If more than one document is picked up, the double detector 74 senses the double thickness and generates a signal to energize a clutch to couple the roller 40 to the drive motor 62 to rotate this roller in the direction of the arrow 84. This causes the lower separator roller 40 to propel the extra document backwards toward the stack 10. Thus, the separator rollers 38 and 40 provide a first selection process for delivering only a single document to the remote distribution station 52.

As the platform 16 reaches its upward extent of travel, the switch 27 is actuated to deenergize the solenoid valve 26 to disconnect the vacuum pump 28 from the suction cup pickup 22.

A single bill transported through the separator rollers 38 and 40 is fed to the flat belt transport 42 and frictionally gripped between the belts 44 and 46 to be transported in the direction of arrows 48 and 50. When the leading edge of the document is detected at the detector station 76, a signal is generated to deenergize the separator rollers 38 and 40 thereby causing these rollers to stop rotation.

With the continuous movement of the flat belts 44 and 46 by the drive motor 62, the document is transported in the direction of the arrows 48 and 50. When the trailing edge of a document passes the detector station 76 a signal is generated to deenergize the platform solenoid 32. This returns the picker platform 16 to a position such that the suction cup pickup 22 rests on the top document in the stack 10.

As a document passes the double detector 80 a check is made to determine if more than one document is moving through the flat belt transport 42. The double detector 80 is not, however, enabled until after a document passes the detector station 76. This is a subsequent multiple document check in addition to the check completed at the double detector 74. If multiple documents are detected at the detector 80, a signal is generated to energize the divert gate solenoid 72 to rotate the divert gate 66 into the dotted line position to cause a document to be diverted in the direction of the arrow 86 into a capture bin.

For the normal condition where only one bill is detected at the double detector 80 the document continues to advance through the flat belt transport 42. Subsequently, the leading edge of the document is detected at the detector station 78. When a document is detected at the station 78 and a document is simultaneously detected at the station 76 the indication is that overlapping or trailing documents are moving through the flat belt transport 42. The distance between the detector stations 76 and 78 is slightly greater than the length of a document in the stack 10. An extra document in the flat belt transport 42, trailing the first document, causes both detector stations 76 and 78 to generate a signal that is combined to energize the divert gate solenoid 72. The divert gate 66 is rotated about the shaft 68 to cause the documents in the flat belt transport 42 to be diverted in the direction as indicated by the arrow 86.

For the condition where only a single document is moving through the flat belt transport 42, the divert gate 66 remains in the position illustrated and the document exits from the transport 42 into the remote distribution station 52. When the trailing edge of the document passes the detector station 78, a signal is generated to deenergize the drive motor 62 and the vacuum pump 28. The entire system is now at rest ready for a subsequent command to again dispense a document from the stack 10 to the distribution station 52.

Referring to FIGS. 2–8, there is shown an actual embodiment of the present invention for transferring paper currency from a storage bin to a remote distribution station. The transportation system is included within a housing having a right side support plate 92 to which is mounted a gear motor 94 for driving a flat belt transport and separator rollers.

Figure 3:
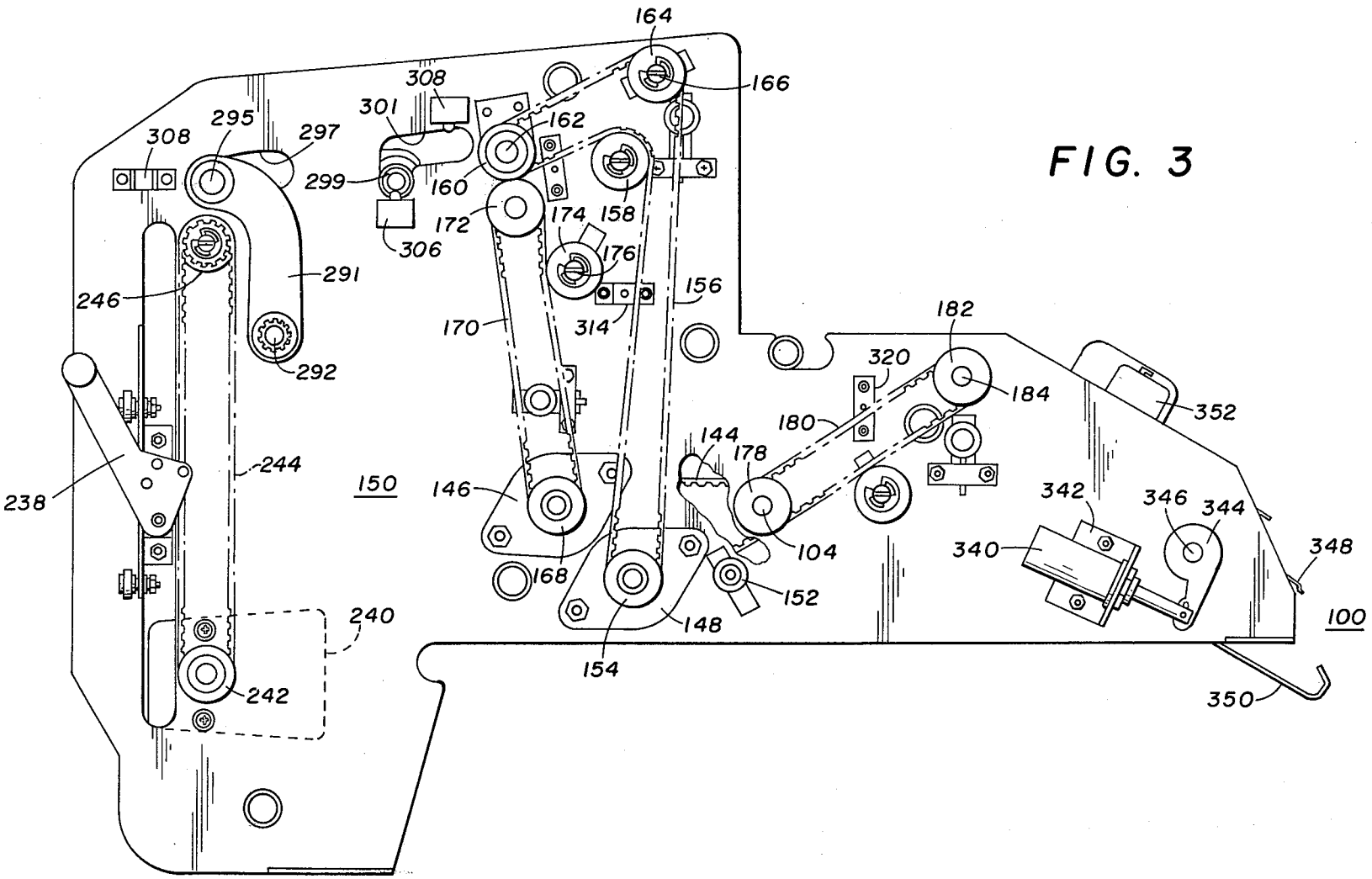
FIG. 3 is a left side view of the document transport of FIG. 2.
Figure 4:
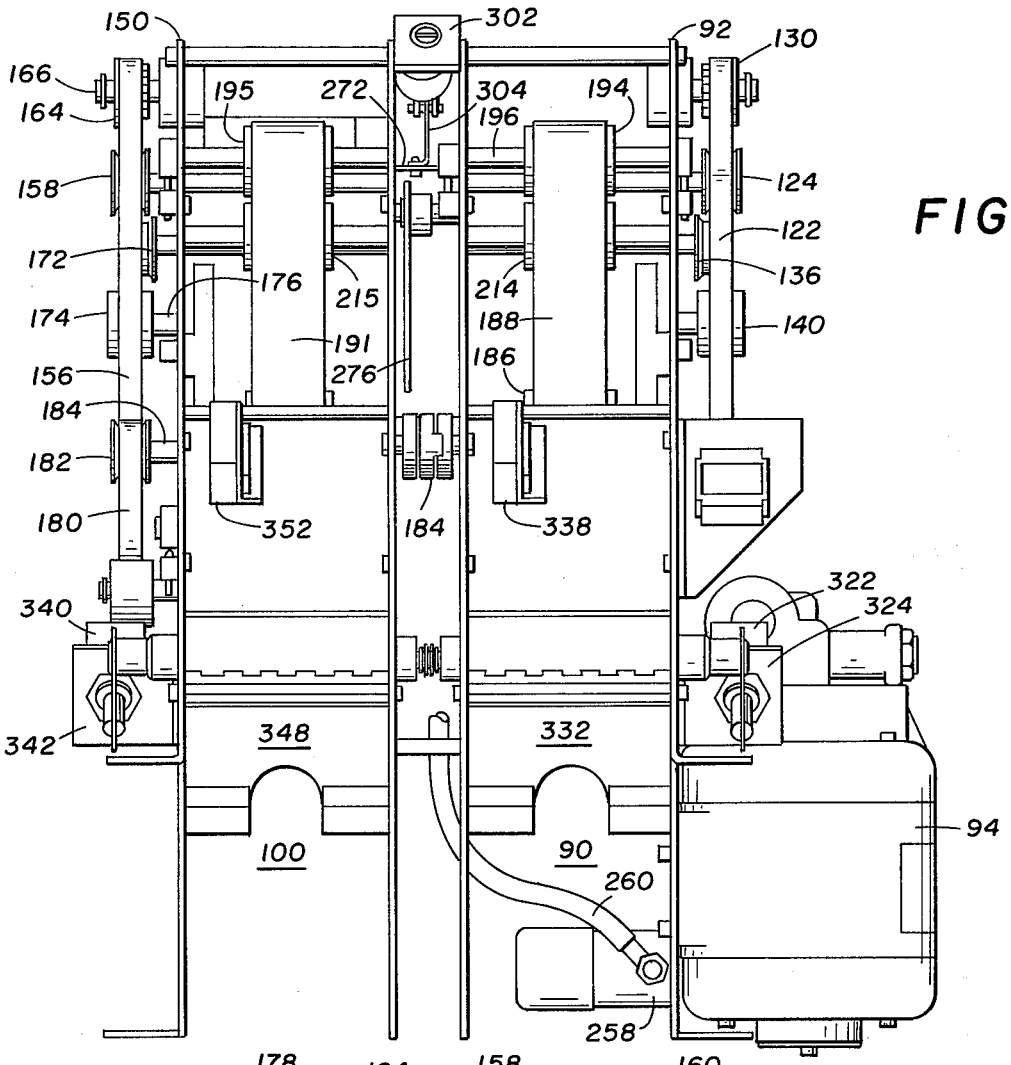
FIG. 4 is a front view of a document transport in accordance with the present invention looking from the delivery station.
Figure 5:
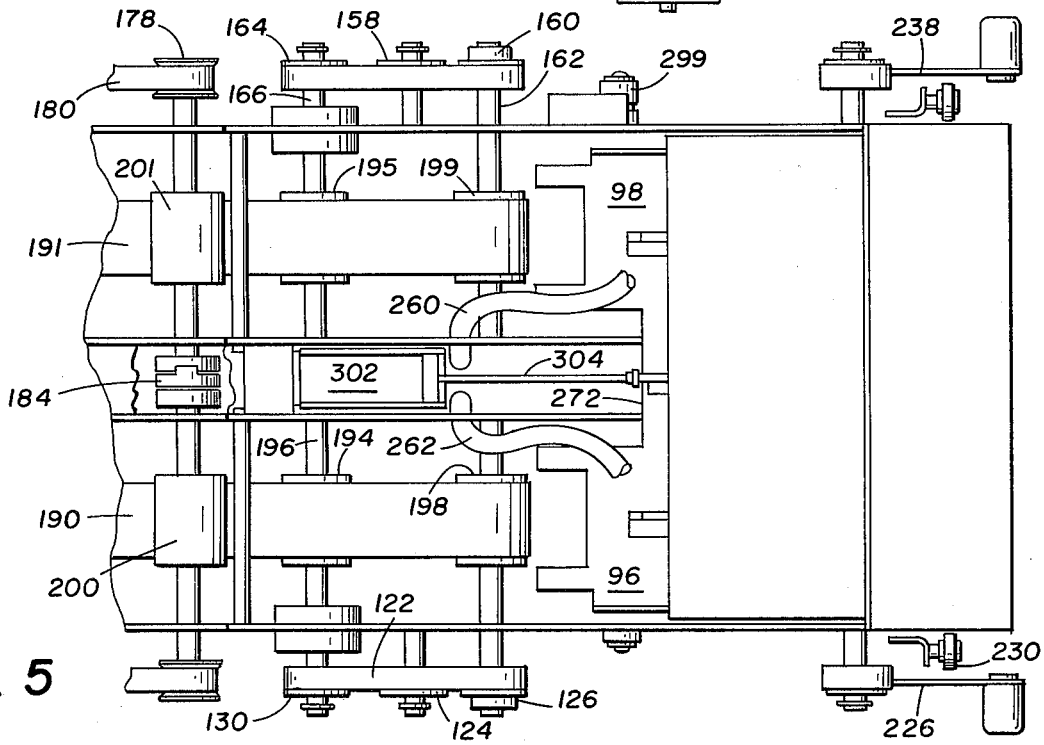
FIG. 5 is a cutaway view of the document transport of FIGS. 2–4.

As best shown in FIGS. 4 and 5, the embodiment of FIGS. 2–8 comprises a dual distribution system for delivering paper currency from storage bins 96 and 98 to remote distribution stations 90 and 100, respectively. The gear motor 94 supplies power for both of the parallel transportation systems.

Coupled to the output shaft of the gear motor 94 is a timing belt 102 (on the inside of the side plate 92) engaging a timing wheel (not shown) on a drive shaft 104. The drive shaft 104 extends through both parallel transportation systems. Also driven from the drive shaft 104 is a timing belt 106 for driving the clutch assemblies 108 and 110 for the separator rollers, to be described, associated with the storage bin 96.

The drive shafts for the clutch assemblies 108 and 100 extend through the side plate 92 to drive pulleys 114 and 116, respectively, in engagement with the belt 106. A tension pulley 118 (FIG. 8) is mounted to the side plate 92 by means of a spring loaded shaft 120.

A drive gear carries by the clutch assembly 110 engages a timing belt 122 that encircles an idler roller 124 mounted to the side plate 92 and then engages a drive gear 126 coupled to the shaft supporting a separator roller 128. Also in the loop of the timing belt 122 is an idler roller 130 mounted to the side plate 92.

For the clutch assembly 108, a drive gear 132 engages a timing belt 134 encircling a drive pulley 136 mounted to the shaft of a lower separator roller 138. A tension roller 140 rides against the outer surface of the timing belt 134 and is mounted to the side plate 92 by means of a spring loaded shaft 142.

With reference to the left hand transportation system, the drive shaft 104 supports a drive pulley (not shown) engaging a timing belt 144 passing around drive gears for clutch assemblies 146 and 148. A tension roller rides against the timing belt 144 and is mounted to a side plate 150 by means of a spring loaded shaft 152.

Coupled to the drive shaft of the clutch assembly 148 is a drive pulley 154 engaging a timing belt 156 that encircles an idler pulley 158 to power a drive pulley 160 coupled to the supporting shaft 162 of the upper separator roller (not shown) for the left hand transportation system. Also in the path of the timing belt 156 is an idler pulley 164 supported on a spring loaded shaft 166.

On the output shaft of the clutch assembly 146 is mounted a drive pulley 168 for powering a timing belt 170 in engagement with a drive pulley 172 coupled to the drive shaft of the lower separator roller (not shown) of the left hand transportation system.

Engaging the timing belt 170 is an idler pulley 174 mounted to the side plate 150 by means of a spring loaded shaft 176.

Also driven by the drive shaft 104 is a drive pulley 178 engaging a timing belt 180 encircling a drive pulley 182 mounted to a shaft 184. The shaft 184 extends through both transportation systems and supports the forward upper guide roller of the flat belt transport for each side.

Figure 8:
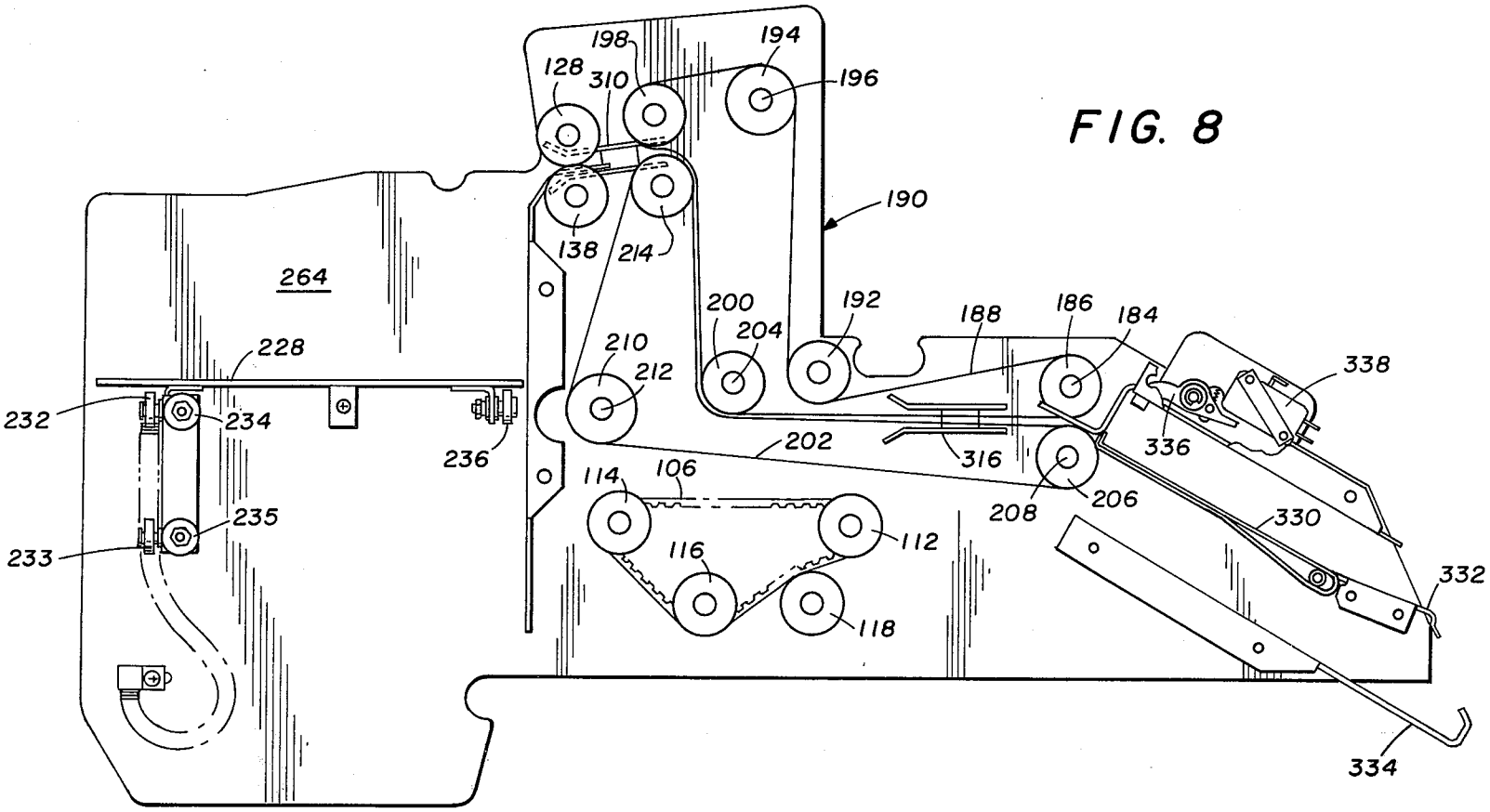
FIG. 8 is a sectional view of the document transport of the present invention showing the transport path for a document through a separator roller pair and subsequently through a flat belt transport.

Referring specifically to FIG. 8, showing the right hand transportation system, the shaft 184 supports a guide roller 186 which is encircled by an upper flat belt 188 of a flat belt transport 190. The path of the belt 188 includes a guide roller 192 mounted on a shaft supported by the side plate 92. The path of the flat belt 188 also includes a guide roller 194 mounted to a spring loaded shaft 196 to the side plate 92. This roller provides a continuous tension on the flat belt 188. Next, the flat belt 188 encircles an input guide roller 198 and then to a guide roller 200 that is common to both the upper flat belt 188 and a lower flat belt 202. The guide roller 200 is mounted to a spring loaded shaft 204.

For the lower flat belt 202, a guide roller 206 is mounted immediately below the roller 186 on a spring loaded shaft 208. Next, the flat belt 202 encircles an idler roller 210 mounted on spring loaded shaft 212 supported on the side plate 92. The flat belt 202 then passes around an input guide roller 214 immediately below the guide roller 198 to form the entrance of the flat belt transport 190.

Although shown separated in FIG. 8, the flat belts 188 and 202 are in contact between the input guide rollers 198 and 214 and the output guide rollers 186 and 206. Movement is imparted to the flat belt transport 190 by driving the shaft 184 through the timing belt 180 and the gear motor 94.

The separator roller arrangement and flat belt transport for the left side transportation system is similar to that illustrated in FIG. 8 for the right side. An upper output guide roller is supported on the shaft 184 to drive the upper and lower flat belts of the left side system. The separator rollers are driven from the drive gears 160 and 172, as explained.

Each of the side-by-side transportation systems includes an elevator for lifting a stack of documents to be transported through the flat belt transport. For the right side, an elevator motor 216 is supported on the inner surface of the side wall 92 with a drive shaft 218 supporting a motor pulley 220. The motor pulley 220 drives a timing belt 222 passing around to an idler pulley 224. Coupled to the timing belt 222 is an elevator assembly 226 including a platform 228. The elevator assembly is guided in its movement along the side wall 92 by means of guide rollers 230-236 to assure a stable movement of the platform 228.

With reference to FIG. 3, a similar elevator assembly 238 is provided for the left side. This elevator assembly 238 is powered by an elevator motor 240 having an output shaft supporting a motor pulley 242. The motor pulley 242 drives a timing belt 244 having an upper extent of travel set by an idler pulley 246. An elevator platform (not shown) similar to the platform 228 is provided for the left side as part of the elevator assembly 238.

By operation of the elevator motors 216 and 240, the top document of a stack is positioned to be moved into the nip of the separator rollers for each independent transporation system. To lift the top document into the nip of the separator rollers a vacuum pump 248 provides a negative pressure; it is attached to the side plate 92 by means of a bracket 250. Also supported by the bracket 250 is a motor 252 for driving the vacuum pump 248 through a coupling 254. Vacuum is supplied to each side of the transportation system by means of a flexible hose 256 that extends through the side plate 92 and connected to the inlet port of the solenoid valve 258. The output port of the solenoid valve 258 is coupled to a flexible line 260 leading to the suction cup pickup for the right side system. A similar solenoid valve (not shown) is provided for the left side system and has a flexible line 262 connected to the suction cup pickup for the left side.

Figure 7:
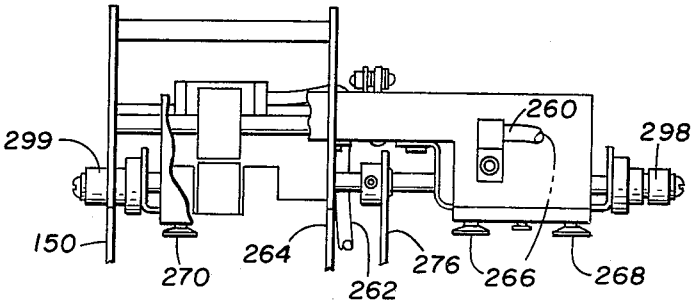
FIG. 7 is a cutaway view of the vacuum pickup assembly of FIG. 6.
Figure 6:
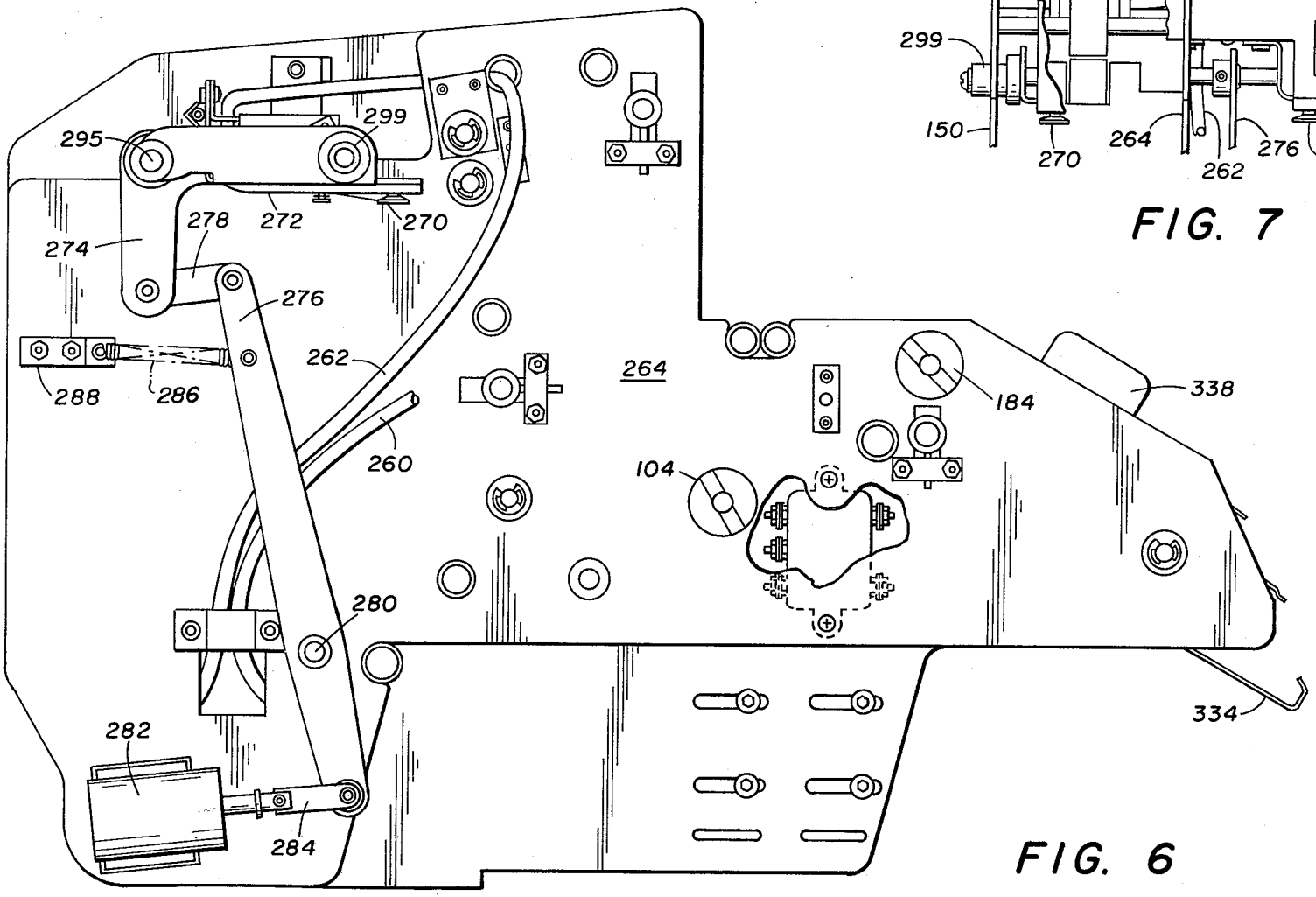
FIG. 6 is a sectional view of a document transport of the present invention illustrating a vacuum document pickup.

Referring to FIGS. 6 and 7, the flexible line 260 extends through a center plate 264 to be connected with suction cup pickups 266 and 268. The flexible line 262 extends through the center plate 264 to be coupled to suction cup pickups of the left side system including the suction cup pickup 270. The suction cup pickups are supported by a picker platform 272 common to both sides of the system. Formed as part of the picker platform 272 is an actuating arm 174 having one end connected to an operating lever 276 by means of a pivoted connecting link 278. The operating lever 276 is pivoted on a shaft 280 and is coupled to a platform solenoid 282 by means of a connecting link 284. The operating lever 276 is biased into the position shown by means of a spring 286 supported on the center plate 264 by a bracket 288.

Actuating the solenoid 282 rotates the operating lever 276 clockwise about the shaft 280 to cause the picker platform 272 to be lifted by means of lift arms 290 and 291 (see FIGS. 2 and 3) pivotally connected to the side plates 92 and 150, respectively, by means of a shaft 292. The lift arm 290 is pivotally connected to the platform 272 by a shaft 294 and the lift arm 291 is connected to the platform by a shaft 295. The shaft 294 moves in a guide slot 296 of the side plate 92 and the shaft 295 moves in a guide slot 297 of the side plate 150.

To guide the movement of a platform 272 guide rollers 298 and 299 are mounted to the leading edge of the platform 272. These guide rollers move in L-shaped slots 300 and 301 in the side plates 92 and 150, respectively. The slots 300 and 301 define the movement of the platform 272 to lift a document from a stack from either the right side or the left side into the nip of the respective separator rollers. A document is lifted only if the appropriate solenoid valve applies a vacuum to the suction cup pickup.

To provide a smooth operation for the lifting motion of the picker platform 272 a dashpot 302 is connected thereto by means of a connecting link 304. This dashpot minimizes bounce and jitter during movement of the platform 272.

As a document is lifted into the nip of the separator rollers by the picker platform 272, the motion of the platform interrupts a switch 306 for the upward travel, a switch 308 is actuated by a downward movement of the platform. Actuating the switches 306 and 308 generates signals to the solenoid valve to control the suction cup pickups.

As shown in FIG. 8, for the right side system, a document passing through the separator rollers 128 and 138 moves through a double detector 310 to control energization of the clutch assembly 108. A similar operation is provided for the left side system wherein a double detector responds to document movement between the separator rollers to control the energization of the clutch assembly 146.

For the right side system, as a document enters the flat belt transport 190 it passes an optical switch 312 which corresponds with a pickup station 76. The optical switch 312 controls the energization of the clutch assembly 110 for the right side. With regard to the left side system, a document moving through the flat belt transport therefor interrupts an optical switch 314 that controls energization of the clutch assembly 148.

A document moving through the right side system then passes a double detector 316 that corresponds to the detector station 80 of FIG. 1. A similar double detector is provided for the left side system. Downstream of the double detector of each side of the transport system is an optical switch that corresponds to the detector station 78 of FIG. 1. For the right side system, an optical switch 318 is attached to the side wall 92 and for the left side an optical switch 320 is attached to the side wall 150. The optical switch 318 functions with the optical switch 312 to monitor overlapping or trailing documents in the flat belt transport 190. Similarly, the optical switch 320 functions with the optical switch 314 to monitor overlapping or trailing documents in the flat belt transport for the left side.

Considering the right side, the optical switches 312 and 318 and the double detector 316 provide signals to control a divert solenoid 322 mounted to the side plate 92 by a bracket 324. The solenoid 322 is coupled to a divert arm 326 connected to a shaft 328 that extends through the side plate 92 to support a divert gate 330. When in the position shown in FIG. 8, the divert gate 330 allows a document transported through the flat belt transport 190 to be delivered to the remote distribution station 90 over a transition plate 332. Energizing the solenoid 322 rotates the divert arm 326 to in turn rotate the divert plate 330 clockwise and a document transported through the flat belt transport 190 is directed into a capture bin 334 for storage and later retrieval. As the divert gate 330 is rotated into the divert position, it strikes an operating lever 336 to control a microswitch 338. The microswitch 338 provides a closure signal to monitor operation of the right side system.

With reference to the left side system, the optical switches 314 and 320 and a double detector provide signals to control a divert solenoid 340 supported on the side plate 150 by a bracket 342. The solenoid is connected to a divert arm 344 supported on a shaft 346 that extends through the side plate 150 and provides a pivotal support for a divert gate (not shown) for the left side system.

The operation of the left side divert is similar to that shown in FIG. 8. When in the normal position, a document delivered by the left side system is transported over a transition plate 348 to the remote distribution station 100. When a divert condition exists, a document delivered to the transporation system is directed into a capture bin 350. Operation of the divert gate for the left side system actuates a microswitch 352, again to provide a closure signal for a system monitoring operation.

Operationally, the embodiment of FIGS. 2–8 is as described previously with reference to FIG. 1. Multiple checks are made throughout the sequence of operation of the transport system to detect multiple or overlapping document delivery. Either condition will produce a mode of operation to prevent more than one document from being delivered to either of the remote distribution stations.

While only one embodiment of the invention, together with modifications thereof, has been described in detail herein and shown in the accompanying drawings, it will be evident that various further modifications are possible without departing from the scope of the invention.

What is claimed is:

1. In a document transport system for transporting documents from a stack to a remote distribution station, comprising in combination:

a pair of separator rollers rotating to transport a document to the distribution station;

means for driving one of said rollers in a direction to transport a document to the distribution station;

means for mounting the second roller of said pair to normally rotate freely in the same direction as said other roller;

means for removing a document from the stack for delivery to said pair of separator rollers;

means at the separator rollers to detect when more than one document moves through said rollers and generate a double detection signal; and means responsive to said signal to couple the second of said rollers to said means for driving to rotate the rollers of said pair in opposite directions.

2. In a document transport system as set forth in claim 1 wherein said means responsive to the double detection signal includes a clutch to connect said means for driving to said second roller to drive the second roller in a direction opposite from the first roller.

3. In a document transport system as set forth in claim 1 including means responsive to the passing of a document through said separator rollers to de-energize said means for driving.

4. In a document transport system as set forth in claim 1 wherein said means at the separator rollers includes a light emitting source positioned on one side of the document path and a light responsive means disposed to receive energy from said source on the opposite side of the document path to generate a detection signal to said means responsive to the detection of more than one document.

5. In a document transport system as set forth in claim 4 wherein said light emitting source is a light emitting diode and said light responsive means includes a photo transistor.

6. In a document transport system for transporting documents from a stack to a remote distribution station, comprising in combination:

A pair of separator rollers rotating to transport a document to the distribution station;

means for driving one of said rollers in a direction to transport a document to the distribution station;

means for mounting the second roller of said pair to normally rotate freely in the same direction as the other roller;

means for removing a document from a stack for delivery to said pair of separator rollers;

means at the separator rollers to detect when more than one document moves through said rollers and generate a double detection signal;

means responsive to said signal to couple the second of said rollers to said means for driving to rotate the rollers of said pair in opposite directions;

an upper and lower transport belt positioned to transport a document therebetween as delivered from said separator rollers to the distribution station;

detector means positioned along the document path through said transport belts to detect when more than one document moves through said belt; and divert means responsive to the detection of more than one document moving through said belts to divert the transported documents from the distribution station.

7. In a document transport system as set forth in claim 6 wherein said divert means includes:

a divert gate pivotally mounted to be rotated into the path of a document from said transport belts to the distribution station; and drive means energized when more than one document enters between said belts to rotate said divert gates into the document path.

8. In a document transport system as set forth in claim 6 wherein said detector means includes a light emitting source positioned on one side of the document path and a light responsive means disposed to receive energy from said source on the opposite side of the document path to generate a detection signal to said divert means.

9. In a document transport system as set forth in claim 6 including means disposed along the document path through said transport belts and responsive to the passing of a document through said separator rollers to de-energize said means for driving.

10. In a document transport system as set forth in claim 6 wherein said means responsive to more than one document through the separator rollers includes a clutch to connect said means for driving to said second roller to drive the second roller in a direction opposite from the first roller.

11. In a document transport system as set forth in claim 6 wherein said detector means includes means responsive to document length to detect when more than one document moves through said transport belts.

12. In a document transport system as set forth in claim 11 wherein said detector means further includes means responsive to overlapping documents to detect when more than one document moves between said transport belts.

13. In a document transport system for transporting documents from a stack to a remote distribution station, comprising in combination:

a pair of separator rollers rotating to transport a document in the direction of the distribution station;

means for driving one of said rollers in a direction to transport a document to the distribution station;

means for mounting the second roller of said pair to normally rotate freely in the same direction as the other said roller;

means for removing a document from the stack for delivery to said pair of separator rollers;

means at the separator rollers to detect when more than one document moves through said rollers and generate a double detection signal;

means responsive to said signal to couple the second of said rollers to said means for driving to rotate the rollers of said pair in opposite directions;

an upper and lower transport belt positioned to transport a document therebetween from said pair of separator rollers to the distribution station;

a first detector station positioned along said transport belt to detect the movement of a document and generate a document signal;

a second detector station positioned along said transport belt downstream of said first detector stationed a distance greater than the length of a document to also generate a document signal; and divert means responsive to the document signals from said first detector station and said second detector station to divert the transported document from the distribution station.

14. In a document transport system as set forth in claim 13 including a double document detector positioned along the document path through said transport belts to generate a double document signal to actuate said divert means to divert the transported documents from the distribution station.

15. In a document transport system as set forth in claim 13 wherein said divert means includes:

a divert gate pivotally mounted to be rotated into the path of a document from said transport belt to the distribution station; and drive means energized by simultaneous document signals from the first and second detector stations and also energized by the double document signal.

16. In a document transport system as set forth in claim 13 including means for driving said transport belts in a direction to transport a document to the distribution station.

17. In a document transport system as set forth in claim 16 including means responsive to the document signal from said second detector station to de-energize said means for driving said transport belts.

18. In a document transport system as set forth in claim 13 wherein said means responsive to the passage of more than one document through said transport rollers includes a clutch to connect said means for driving to said second roller to drive the second roller in a direction opposite from the first roller.

19. In a document transport system as set forth in claim 13 including means responsive to the document signal from said first detector station to de-energize said means for driving.

* * * * *

PO-1050
(5/69)

UNITED STATES PATENT OFFICE

CERTIFICATE OF CORRECTION

Patent No. 3,937,453 Dated February 10, 1976

Inventor(s) Richard C. Hickey, Jerry W. Swafford, Robert F. Swartzendruber and Thomas R. Barnes It is certified that error appears in the above-identified patent and that said Letters Patent are hereby corrected as shown below:

In the heading, "Thomas P. Barnes" should be --Thomas R. Barnes"

Col. 5, line 61, "100" should be --110--;
line 65, "carries" should be --carried--.
Col. 7, line 52, "174" should be --274--.
Col. 9, line 24, after "for" delete "a".
Col. 10, line 16, "A" should be --a--.

Signed and Sealed this twenty-seventh Day of April 1976

[SEAL]

Attest:

RUTH C. MASON
*Attesting Officer*

C. MARSHALL DANN
*Commissioner of Patents and Trademarks*